US011063335B2

(12) United States Patent
Doumanis et al.

(10) Patent No.: US 11,063,335 B2
(45) Date of Patent: Jul. 13, 2021

(54) RESONATOR

(71) Applicant: Nokia Technologies Oy, Espoo (FI)

(72) Inventors: Efstratios Doumanis, Dublin (IE); Senad Bulja, Dublin (IE)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/468,893

(22) PCT Filed: Dec. 8, 2017

(86) PCT No.: PCT/EP2017/082011

§ 371 (c)(1),
(2) Date: Jun. 12, 2019

(87) PCT Pub. No.: WO2018/108733

PCT Pub. Date: Jun. 21, 2018

(65) Prior Publication Data

US 2020/0083590 A1 Mar. 12, 2020

(30) Foreign Application Priority Data

Dec. 12, 2016 (EP) ..... 16203430

(51) Int. Cl.
*H01P 7/06* (2006.01)
*H01P 1/205* (2006.01)

(52) U.S. Cl.
CPC ..... *H01P 7/065* (2013.01); *H01P 1/205* (2013.01)

(58) Field of Classification Search
None
See application file for complete search history.

(56) References Cited

U.S. PATENT DOCUMENTS 4,660,005 A 4/1987 Hutchinson
9,343,790 B2 * 5/2016 Ruiz-Cruz ..... H01P 1/2053
(Continued)

FOREIGN PATENT DOCUMENTS

EP 3 012 902 A1 4/2016
KR 2008 0089782 A 10/2008
(Continued)

OTHER PUBLICATIONS

ANSYS HFSS, "3D Electromagnetic Field Simulator for RF and Wireless Design," https://www.ansys.com/products/electronics/ansys-hfss, 5 pages, (copyright date 2019).
(Continued)

*Primary Examiner* — Robert J Pascal
*Assistant Examiner* — Kimberly E Glenn
(74) *Attorney, Agent, or Firm* — Fay Sharpe LLP

(57) ABSTRACT

A resonator assembly and method are disclosed. The resonator assembly comprises: a resonant chamber defined by a first wall, a second wall opposing the first wall and side walls extending between the first wall and the second wall; a first resonator comprising a first resonator element and a first resonator cap, the first resonator element having a first grounded end and an first open end, the first resonator element being grounded at the first grounded end on the first wall and extending into the resonant chamber, the first resonator cap having a first grounded portion and an first open portion, the first resonator cap being grounded at the first grounded portion on the second wall and extending into the resonant chamber to at least partially surround the first open end of the first resonator element with the first open portion for electrical field loading of the first resonator element by the first resonator cap; and a second resonator comprising a second resonator element and a second resonator cap located for electrical field loading of the second resonator element by the second resonator cap, the second resonator element being located for magnetic field coupling between the first resonator element and the second resonator element. In this way, a compact resonator assembly is provided having high operational performance. The provision of resonators having resonator elements and resonator caps helps to reduce the height of the resonator assembly to around one eighth of the operating wavelength. The provi-
(Continued)

sion of the resonator caps helps to contain the electrical field from the resonator elements, which enables adjacent resonator elements to be located closer together to provide for enhanced magnetic field coupling therebetween.

15 Claims, 8 Drawing Sheets

(56) References Cited

U.S. PATENT DOCUMENTS

| | | | |
|---|---|---|---|
| 2008/0239187 | A1 | 10/2008 | Yang et al. |
| 2011/0241801 | A1 | 10/2011 | Subedi |
| 2014/0347148 | A1 | 11/2014 | Ruiz-Cruz et al. |

FOREIGN PATENT DOCUMENTS

| | | | |
|---|---|---|---|
| KR | 2008-0089782 | A | 10/2008 |
| WO | WO 2012/109807 | A1 | 8/2012 |

OTHER PUBLICATIONS

Ke-Li Wu et al, "A Full Wave Analysis of a Conductor Post Insert Reentrant Coaxial Resonator in Rectangular Waveguide Combline Filters," IEEE MTT-S International Microwave Symposium Digest, XP032373002, pp. 1639-1642, 1996.

Richard J. Cameron et al., "Microwave Filters for Communication Systems, Fundamentals, Design, and Applications," Second Edition, pp. 375-376, 2018.

International Search Report for PCT/EP2017/082011 dated Mar. 19, 2018.

* cited by examiner

RESONATOR

FIELD OF THE INVENTION

The present invention relates to a resonator for telecommunications. Embodiments relate to a resonator assembly for radio frequency (RF) filters and a method.

BACKGROUND

Filters are widely used in telecommunications. Their applications vary from mobile cellular base stations, through radar systems, amplifier linearization, to point-to-point radio and RF signal cancellation, to name a few. The choice of a filter is ultimately dependent on the application; however, there are certain desirable characteristics that are common to all filter realisations. For example, the amount of insertion loss in the pass-band of the filter should be as low as possible, while the attenuation in the stop-band should be as high as possible. Further, in some applications, the guard band—the frequency separation between the pass-band and stop-band—needs to be very small, which requires filters of high-order to be deployed in order to achieve this requirement. However, the requirement for a high-order filter is always accompanied by an increase in the cost (due to a greater number of components that a filter requires) and size. Furthermore, even though increasing the order of the filter increases the attenuation in the stop-band, this inevitably increases the losses in the pass-band.

One of the challenging tasks in filter design is filter size reduction with a simultaneous retention of excellent electrical performance comparable with larger structures. One of the main parameters governing filter's selectivity and insertion loss is the so-called quality factor of the elements comprising the filter—"Q factor". The Q factor is defined as the ratio of energy stored in the element to the time-averaged power loss. For lumped elements that are used particularly at low RF frequencies for filter design, Q is typically in the range of ~60-100 whereas, for cavity type resonators, Q can be as high as several 1000s. Although lumped components offer significant miniaturization, their low Q factor prohibits their use in highly-demanding applications where high rejection and/or selectivity is required. On the other hand, cavity resonators offer sufficient Q, but their size prevents their use in many applications. The miniaturization problem is particularly pressing with the advent of small cells, where the volume of the base station should be minimal, since it is important the base station be as inconspicuous as possible (as opposed to an eyesore). Moreover, the currently-observed trend of macro-cell base stations lies with multiband solutions within a similar mechanical envelope to that of single-band solutions without sacrificing the system's performance.

For the high-medium power base station filter applications, with an emphasis on the lower-end of the frequency spectrum (e.g., 700 MHz), the physical volume and weight of RF hardware equipment poses significant challenges (cost, deployment, etc.) to the network equipment manufactures/providers. The technical problem described above, comes as a consequence of the fact that the RF system electrical requirements impose stringent specification requirements on the filter electrical performance (e.g. isolation requirements in duplexers). This imposes in turn, increased physical size, insertion loss, with regards to the electrical/physical properties but also higher cost (manufacturing, assembly, tuning, etc.).

Accordingly, it is desired to minimize the physical size and profile of cavity resonators/filters (that can offer the high Q), focusing on a low-profile suitable also for small-cell outdoor products.

SUMMARY

According to a first aspect, there is provided a resonator assembly, comprising: a resonant chamber defined by a first wall, a second wall opposing the first wall and side walls extending between the first wall and the second wall; a first resonator comprising a first resonator element and a first resonator cap, the first resonator element having a first grounded end and an first open end, the first resonator element being grounded at the first grounded end on the first wall and extending into the resonant chamber, the first resonator cap having a first grounded portion and an first open portion, the first resonator cap being grounded at the first grounded portion on the second wall and extending into the resonant chamber to at least partially surround the first open end of the first resonator element with the first open portion for electrical field loading of the first resonator element by the first resonator cap; and a second resonator comprising a second resonator element and a second resonator cap located for electrical field loading of the second resonator element by the second resonator cap, the second resonator element being located for magnetic field coupling between the first resonator element and the second resonator element.

The first aspect recognises that the height and density of resonators within a resonant structure is constrained by the operation of those resonators. For example, the first aspect recognises that in a conventional arrangement, the height is typically constrained to approximately a quarter wavelength at the operating frequency and the proximity of resonators is constrained by the presence of an electric field at the open end of the resonator.

Accordingly, a resonator or resonator assembly is provided. The resonator assembly may comprise a resonant chamber or enclosure. The resonant chamber may be defined or have a first wall. The resonant chamber may also have a second wall. The second wall may oppose or be located away from the first wall. The resonant chamber may also have side walls which extend, or are provided between, the first wall and the second wall. The resonator assembly may also comprise a first resonator. The first resonator may have a first resonator element, together with a first resonator cap, hat or cover. The first resonator element may have a grounded end and an open or ungrounded end. The first resonator element may be electrically grounded on the first wall at the first grounded end. The first resonator end may upstand from the wall, extending into the resonant chamber. The first resonator cap may have a first grounded portion or part and a first open portion or part. The first resonator cap may be electrically grounded on the second wall at the first grounded portion. The first resonator cap may upstand or extend into the resonant chamber. The first resonant cap may at least partially surround the first open end of the first resonator element. The resonator cap may at least partially surround the first open end with the first open portion. Surrounding the first open end with the first open portion may electrically load the first resonant element with the first resonant cap and may help to contain the electric field therebetween. The resonator assembly may also comprise a second resonator. The second resonator may have a second resonator element and a second resonator cap. The second resonator cap may be located with respect to the second resonator element to provide electrical field loading of the second resonator element by the second resonator cap in order to help contain the electrical field therebetween. The second resonator element may be located or positioned to provide for magnetic field coupling between the first resonator element and the second resonator element. In this way, a compact resonator assembly is provided having high operational performance. The provision of resonators having resonator elements and resonator caps helps to reduce the height of the resonator assembly to around one eighth of the operating wavelength. The provision of the resonator caps helps to contain the electrical field from the resonator elements, which enables adjacent resonator elements to be located closer together to provide for enhanced magnetic field coupling therebetween.

In one embodiment, the second resonator element has a second grounded end and a second open end, the second resonator element being grounded at the second grounded end on one of the first wall and the second wall and extending into the resonant chamber, and the second resonator cap has a second grounded portion and a second open portion, the second resonator cap being grounded at the second grounded portion on another one of the first wall and second wall, the second resonator cap extending into the resonant chamber to at least partially surround the second open end of the second resonator element with the second open portion for electrical field loading of the second resonator element by the second resonator cap. Accordingly, the resonator elements may either extend from the same wall or extend from differing walls. Likewise, the resonator caps may extend from the same wall or from differing walls.

In one embodiment, the assembly comprises at least one further resonator, each comprising a further resonator element and a further resonator cap, adjacent resonator elements being located for magnetic field coupling therebetween. Accordingly, one or more additional resonators may be provided, positioned for magnetic field coupling between adjacent resonator elements.

Embodiments recognise that using such assemblies at high frequencies requires a significant performance improvement as the frequency increases and is particularly demanding for 5 G bands (3.5 GHz). Accordingly, in one embodiment, the resonator elements each are one of metallic and ceramic. Accordingly, the resonator elements may be either made of a metal or a ceramic.

In one embodiment, at least one resonator element is ceramic and at least one resonator element is metallic. Accordingly, some of the resonator elements may be either made a ceramic, with the remaining resonator elements being made of a metal.

In one embodiment, the resonator caps are metallic. Accordingly, the resonator caps may be made of a metal.

In one embodiment, the resonator elements each comprise an elongate post.

In one embodiment, the resonator elements each have an effective electrical length of around one eighth of an operating wavelength of the resonator assembly. It will be appreciated that the effective electrical length of the resonator elements can be adjusted, depending on the design requirements.

In one embodiment, the resonator elements each have an effective electrical length of around 1/32 of an operating wavelength of the resonator assembly In one embodiment, the resonator caps each surround a respective resonator element. Accordingly, the caps may completely surround an associated resonator element.

In one embodiment, the resonator caps each comprise a tube extending at least partially along an axial length of a respective resonator element. Accordingly, the resonator caps may be formed as a tube within which the resonator element may be at least partially received.

In one embodiment, an internal shape of the resonator caps each match an external shape of a respective resonator element. Having similar shaped caps and elements helps provide for a more uniform electric field and reduces current concentration.

In one embodiment, a cross-sectional shape of at least one of the resonator caps and the resonator elements are one of circular, rectangular and elliptical.

In one embodiment, an inner cross-sectional shape and an outer cross-sectional shape of at least one of the resonator caps and the resonator elements differ. Accordingly, the shape profile of the inner surface and the shape profile of the outer surface may be different In one embodiment, the resonator caps are unitary. Accordingly, the resonator caps may be formed from a single common structure. This helps to reduce the complexity of assembling the resonator assembly.

In one embodiment, each resonator is arranged in at least one of a linear, triangular grid, circular grid, rectangular grid and elliptical grid layout for magnetic field coupling between adjacent resonator elements. Accordingly, a variety of different layouts may be utilised, depending upon design requirements.

In one embodiment, each resonator is arranged in a skewed grid layout for magnetic field coupling between adjacent resonator elements.

In one embodiment, the apparatus comprises a plurality of adjacent resonant chambers, each having a plurality of the resonators. Accordingly, one or more adjacent resonant chambers may be arranged, typically having coupling apertures therebetween, in order to build a filter with the required characteristics.

According to a second aspect, there is provided a method of radio frequency filtering, comprising passing a signal for filtering through a resonant assembly of the first aspect.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present invention will now be described further, with reference to the accompanying drawings, in which.

DESCRIPTION OF THE EMBODIMENTS

Before discussing the embodiments in any more detail, first an overview will be provided. Embodiments provide for a high-performance, compact resonator assembly. The provision of a resonator formed by a resonator element and a resonator cap enables the height of the resonator assembly to be reduced significantly, typically from around a quarter wavelength to one eighth of the wavelength at the operating frequency. Also, the provision of the resonator cap helps to contain an electric field generated by the resonator element, which enables adjacent resonator elements to be located closer together in a more unconstrained manner, which provides for a more compact arrangement and enhanced magnetic coupling therebetween. Using this structure, it is possible to locate the resonators on differing walls of the resonant chamber in order to further isolate electric fields and enhance magnetic coupling between the resonator elements. The number and layout of the resonator elements is not constrained and can be selected based on the design requirements. Also, multiple resonant chambers, each having their own configuration or identical configurations, can be placed adjacent each other in order to build a filter having the required characteristics.

Conventional Combline Resonator Structure

Figure 1:
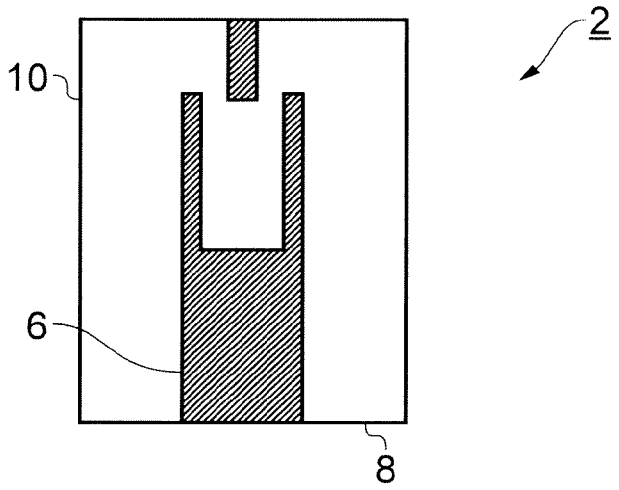
FIG. 1 illustrates a basic form of a combline resonator structure.

In mobile cellular communication base stations, cavity filters are preferable (in terms of cost, technological maturity, market availability, etc.). A standard building block of cavity filters is a combline resonator structure 2, depicted in its basic form in FIG. 1. A resonator post 6 is grounded on the bottom 8 of a resonator cavity 10. It will be understood that the nomenclature top wall, bottom wall, side walls, is intended to distinguish the walls from each other and resonators may function in any orientation relative to the Earth. In operation, the resonator structure 2 resonates in known manner at a frequency where the resonator post 6 height is approximately one quarter-wavelength.

Re-Entrant Resonator Structure

Figure 2:
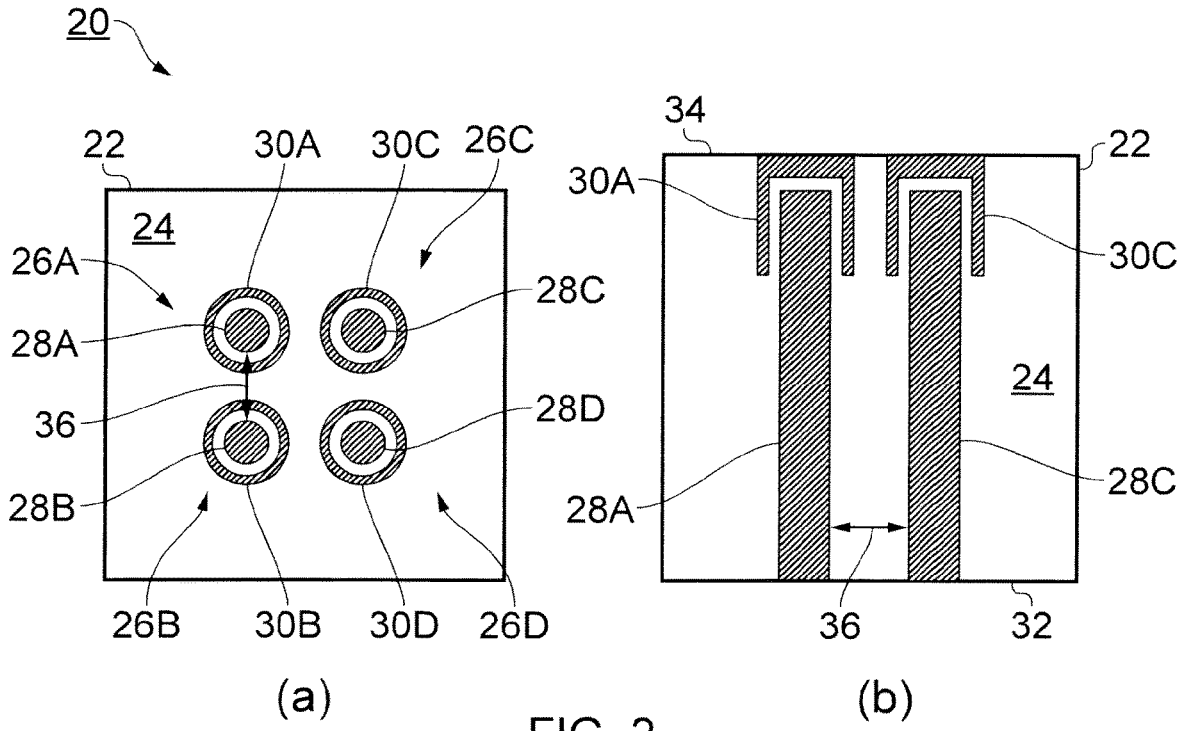
FIG. 2 illustrates a distributed re-entrant resonator structure according to one embodiment where (a) is cross-sectional top view and (b) is a cross-sectional front view.

FIG. 2 illustrates a distributed re-entrant resonator structure 20, where (a) is cross-sectional top view and (b) is a cross-sectional front view. The resonator structure 20 has a cavity enclosure 22, a cavity 24 and a number of resonators 26A-26D, and a tuner (not shown). Each resonator 26A-26D has two parts, a resonator post 28A-28D and a resonator cover 30A-30D. Each resonator post 28A-28D is grounded to one wall 32 of the cavity enclosure 22 and extends into the cavity 24. Each resonator cover 30A-30D is grounded to an opposing wall 34 of the cavity enclosure 22 and extends into the cavity 24. Hence, all the resonator posts 28A-28D protrude into the cavity 24 from one side/surface. The tuner (not shown) protrudes the cavity 24 from the opposite side. In operation, the resonators 26A-26D resonate at a frequency where the resonator post 28A-28D height is approximately one eighth-wavelength.

This arrangement brings a range of benefits which include:

1. Low-cost—by adopting deep-drawn pieces for the resonator covers 30A-30D of each resonator 26A-26D. The resonator covers 30A-30D are attached with screws to opposing wall 34 of the cavity enclosure 22.

2. Low manufacturing complexity—by not requiring machining on both sides of the cavity enclosure 22—machining may even not be required once all the resonator post 28A-28D are screwed to the wall 32 of the cavity enclosure 22 and the resonator covers 30A-30D are deep-drawn pieces that are also screwed on the opposing wall 34 of the cavity enclosure 22.

3. Easy of tuning—requires only a single tuner (not shown)

4. Miniaturization factor—reduced frequency of operation with the same number of resonators 26A-26D (e.g. 4 resonators).

5. Retain high performance—comparable performance as compared to the conventional resonator structure.

6. Significant reduced physical volume—reduced profile and volume as compared to the conventional resonator structure.

In operation, a signal is received via an input signal feed (not shown) within the cavity 24. The input signal feed magnetically couples with a resonator post 28A-28D. An electric current flows along the surface of the resonator post 28A-28D and an electric field is generated at the open end of the resonator post 28A-28D between that open end and the associated resonator cover 30A-30D, which acts as a load on the resonator post 28A-28D. The electric field is contained by the associated resonator cover 30A-30D, which minimises electrical field coupling between resonator posts 28A-28D. The magnetic field generated by the resonator post 28A-28D in response to the input signal feed in turn magnetically couples across an inter-post gap 36 with adjacent resonator posts 28A-28D. The magnetic coupling then continues between the resonator posts 28A-28D and the signal distributes across the array. A filtered signal is then received at an output signal feed (not shown).

This arrangement was then simulated with HFSS using a circular cavity. Table 1 gives the physical dimensions of the resonator simulated. The volume of the resonator is 8.02 $cm^3$. Table 2 shows the simulated performance of the example resonator.

TABLE 1

| Resonator dimensions | |
|---|---|
| Feature | Dimension |
| Circular Cavity (Diameter × Length) | 3.2 cm × 1.0 cm (8.02 $cm^3$) |
| Resonator Post - Resonator Cover - Post/Cover Gap | 9.2 mm/5.2 mm/0.8 mm |

TABLE 2

| Simulated performance based on HFSS Eigenmode solver - the results are preliminary, not optimized | | | | |
|---|---|---|---|---|
| Resonator | Electrical Length @1800 MHz (166.67 mm) | Gap Size | Resonant frequency | Q-Factor (Au/Au) $5.4 \times 10^{07}$ S/m |
| FIG. 2 | ~0.06 λ0 or ~21.6 deg | 0.8 (mm) | ~1850 MHz | ~2250 |

Re-Entrant Resonator Structure—Interdigitated

Figure 3:
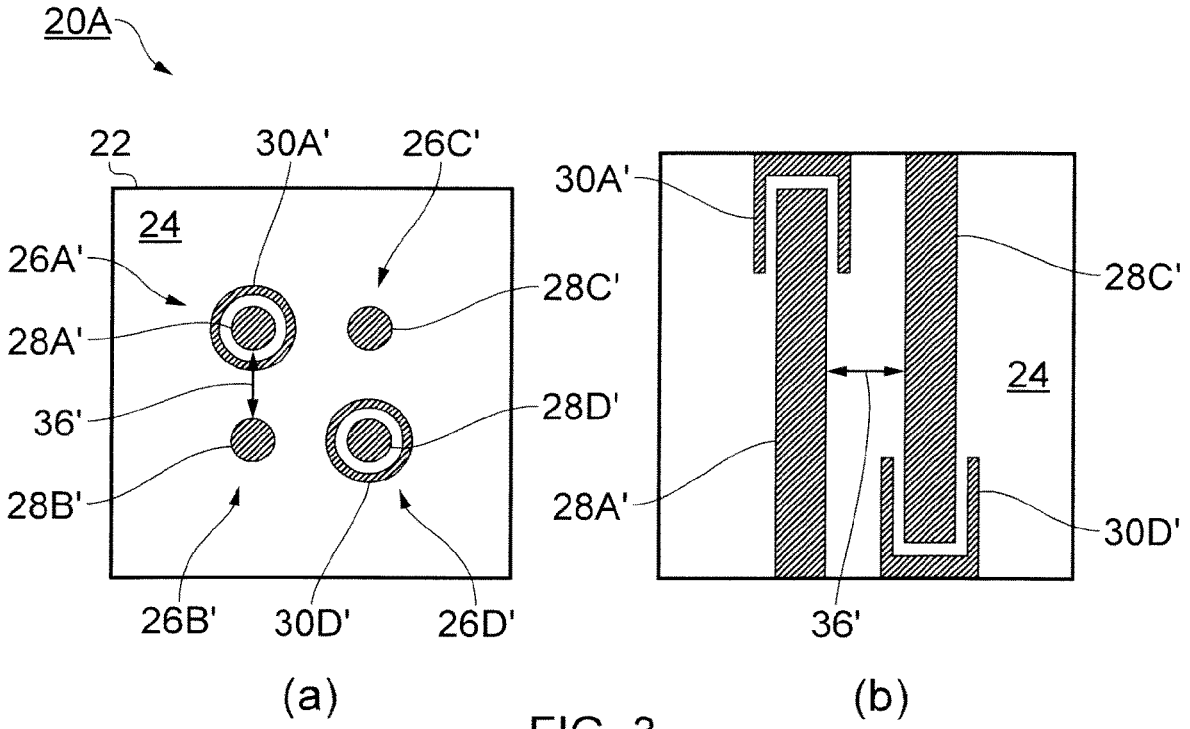
FIG. 3 illustrates an interdigitated distributed re-entrant resonator structure according to one embodiment where (a) is cross-sectional top view and (b) is a cross-sectional front view.

FIG. 3 illustrates an interdigitated distributed re-entrant resonator structure 20A, where (a) is cross-sectional top view and (b) is a cross-sectional front view. The resonator structure 20A has a cavity enclosure 22, a cavity 24 and a number of resonators 26A'-26D', and a tuner (not shown). Each resonator 26A'-26D' has two parts, a resonator post 28A'-28D' and a resonator cover 30A'-30D'. Resonator posts 28A' and 28D' are grounded to one wall 32 of the cavity enclosure 22 and extend into the cavity 24. Resonator covers 30A' and 30D' are grounded to an opposing wall 34 of the cavity enclosure 22 and extend into the cavity 24. Resonator posts 28B' and 28C' are grounded to one wall 34 of the cavity enclosure 22 and extend into the cavity 24. Resonator covers 30B' and 30C' are grounded to an opposing wall 32 of the cavity enclosure 22 and extend into the cavity 24. Hence, the resonator posts 28A'-28D' protrude into the cavity 24 from alternating sides/surfaces as an interdigitated arrangement. The tuner (not shown) protrudes the cavity 24 from one side.

In operation, a signal is received via an input signal feed (not shown) within the cavity 24. The input signal feed magnetically couples with a resonator post 28A'-28D'. An electric current flows along the surface of the resonator post 28A'-28D' and an electric field is generated at the open end of the resonator post 28A'-28D' between that open end and the associated resonator cover 30A'-30D', which acts as a load on the resonator post 28A'-28D'. The electric field is contained by the associated resonator cover 30A'-30D' and adjacent resonator covers 30A'-30D' are spatially separated, which minimises electrical field coupling between resonator posts 28A'-28D'. The magnetic field generated by the resonator post 28A'-28D' in response to the input signal feed in turn magnetically couples across an inter-post gap 36' with adjacent resonator posts 28A'-28D'. The magnetic coupling then continues between the resonator posts 28A'-28D' and the signal distributes across the array. A filtered signal is then received at an output signal feed (not shown).

Re-Entrant Resonator Structure Module

Figure 4:
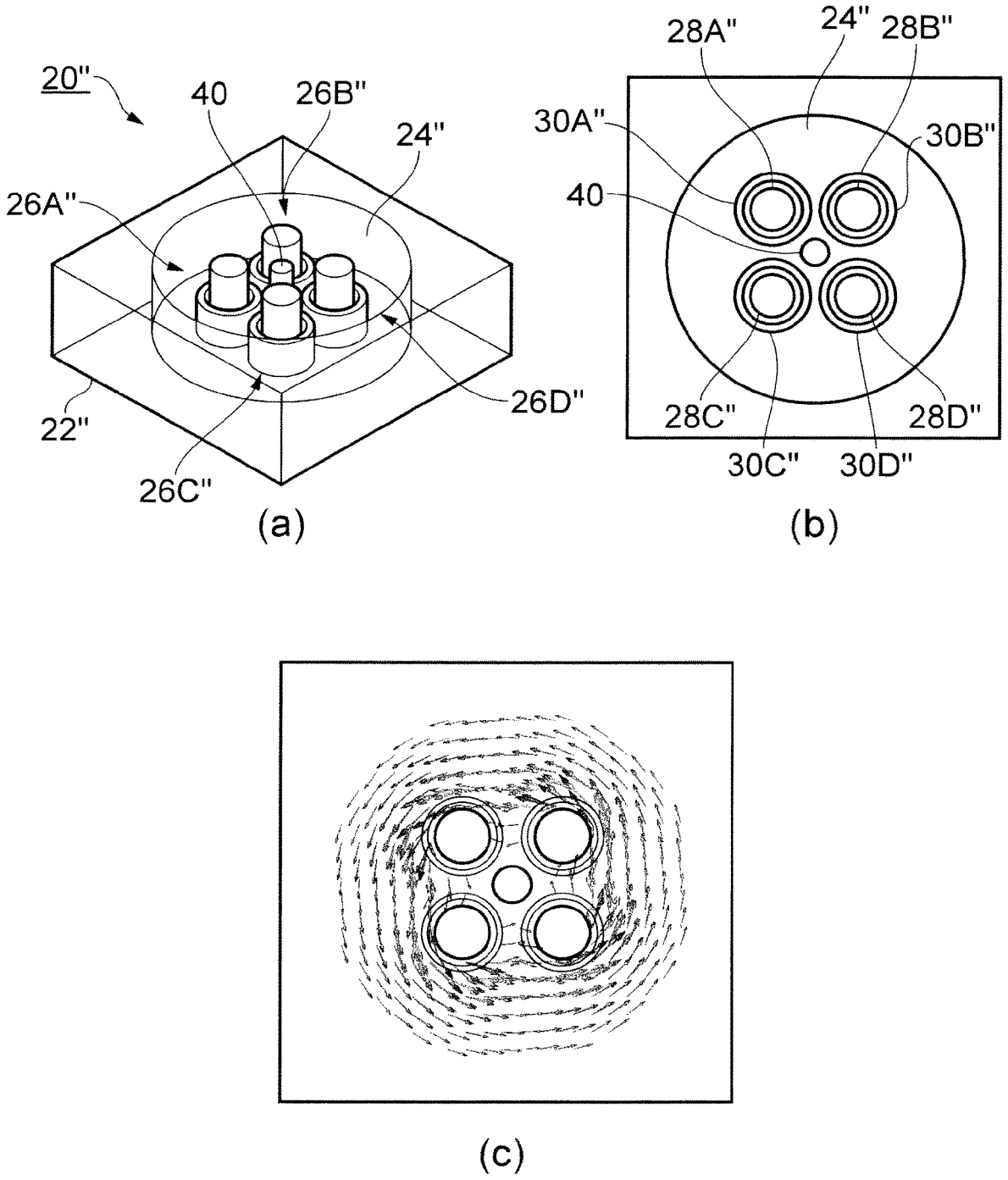
FIG. 4 illustrates a distributed re-entrant resonator structure according to one embodiment where (a) is cross-sectional perspective view, (b) is a cross-sectional top view and (c) illustrates the magnetic field distribution.

FIG. 4 illustrates a distributed re-entrant resonator structure 20", where (a) is cross-sectional perspective view, (b) is a cross-sectional top view and (c) illustrates the magnetic field distribution. The resonator structure 20" has a cavity enclosure 22", a cavity 24" and a number of resonators 26A"-26D", and a tuner 40. Each resonator 26A"-26D" has two parts, a resonator post 28A"-28D" and a resonator cover 30A"-30D". Each resonator post 28A"-28D" is grounded to one wall (not shown) of the cavity enclosure 22" and extends into the cavity 24. Each resonator cover 30A"-30D" is grounded to an opposing wall 34" of the cavity enclosure 22" and extends into the cavity 24". Hence, all the resonator posts 28A-28D" protrude into the cavity 24" from one side/surface.

In operation, a signal is received via an input signal feed (not shown) within the cavity 24". The input signal feed magnetically couples with a resonator post 28A"-28D". An electric current flows along the surface of the resonator post 28A"-28D" and an electric field is generated at the open end of the resonator post 28A"-28D" between that open end and the associated resonator cover 30A"-30D", which acts as a load on the resonator post 28A"-28D". The electric field is contained by the associated resonator cover 30A"-30D", which minimises electrical field coupling between resonator posts 28A"-28D". As shown in FIG. 4(*c*), the magnetic field generated by the resonator post 28A"-28D" in response to the input signal feed in turn magnetically couples across an inter-post gap 36 with adjacent resonator posts 28A"-28D". The magnetic coupling then continues between the resonator posts 28A"-28D" and the signal distributes across the array. A filtered signal is then received at an output signal feed (not shown).

In this embodiment the resonators 26A"-26D" can be interdigitated as mentioned above or can even be arbitrarily interdigitated.

Filter

Figure 5A:
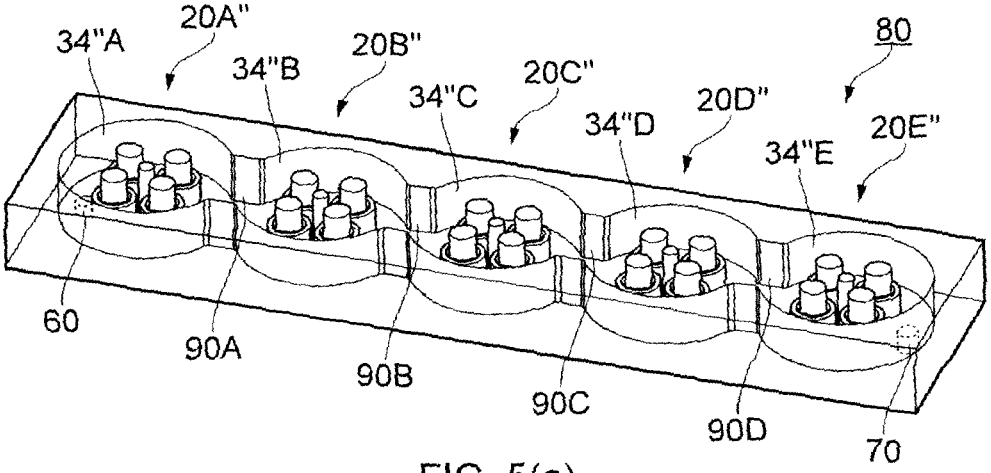
FIGS. 5(*a*) and 5(*b*) are cross-sectional perspective views of a filter arrangement of the re-entrant resonator structure modules according to one embodiment.
Figure 5B:
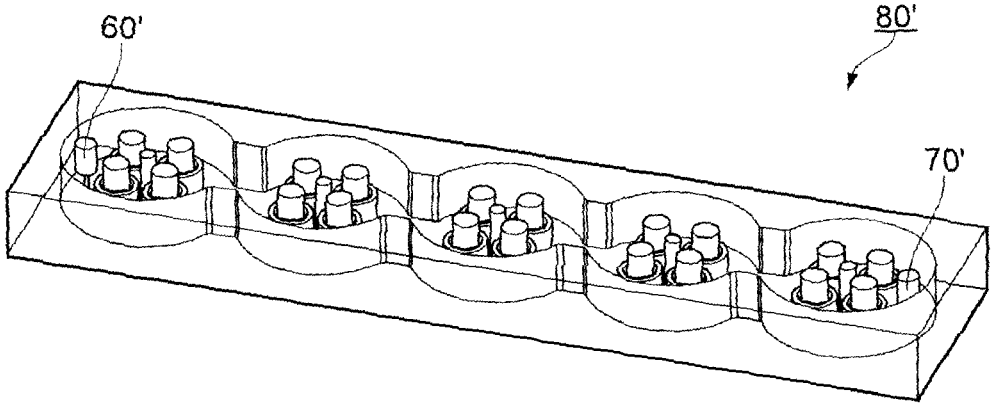

FIG. 5(*a*) is a cross-sectional perspective view of a filter arrangement 80 of the re-entrant resonator structure modules mentioned above. In this example, 5 modules 20"A-20"E are utilised, with inter-module apertures 90A-90D provided for magnetic coupling therebetween.

In operation, a signal is received via an input signal feed 60 within the cavity 34"A. The input signal feed magnetically couples with the resonator posts. Resonator posts within the cavity 34"A magnetically couple with resonator posts within the cavity 34"B via the aperture 90A, which in turn couple with resonator posts within the cavity 34"C via the aperture 90B, and so on. A filtered signal is then received at an output signal feed 70.

It will be appreciated that fewer or more re-entrant resonator structure modules may be provided and that they need not all be identical in configuration. It will also be appreciated that fewer or more than 4 resonators may be provided and that they may be arranged in different configurations, as mentioned above.

FIG. 5(*b*) is a cross-sectional perspective view of a filter arrangement 80' of the re-entrant resonator structure modules mentioned above. This arrangement is identical to that illustrated in FIG. 5(*a*), with the exception of slightly different configuration input signal feed 60' and output signal feed 70'.

Figure 8:
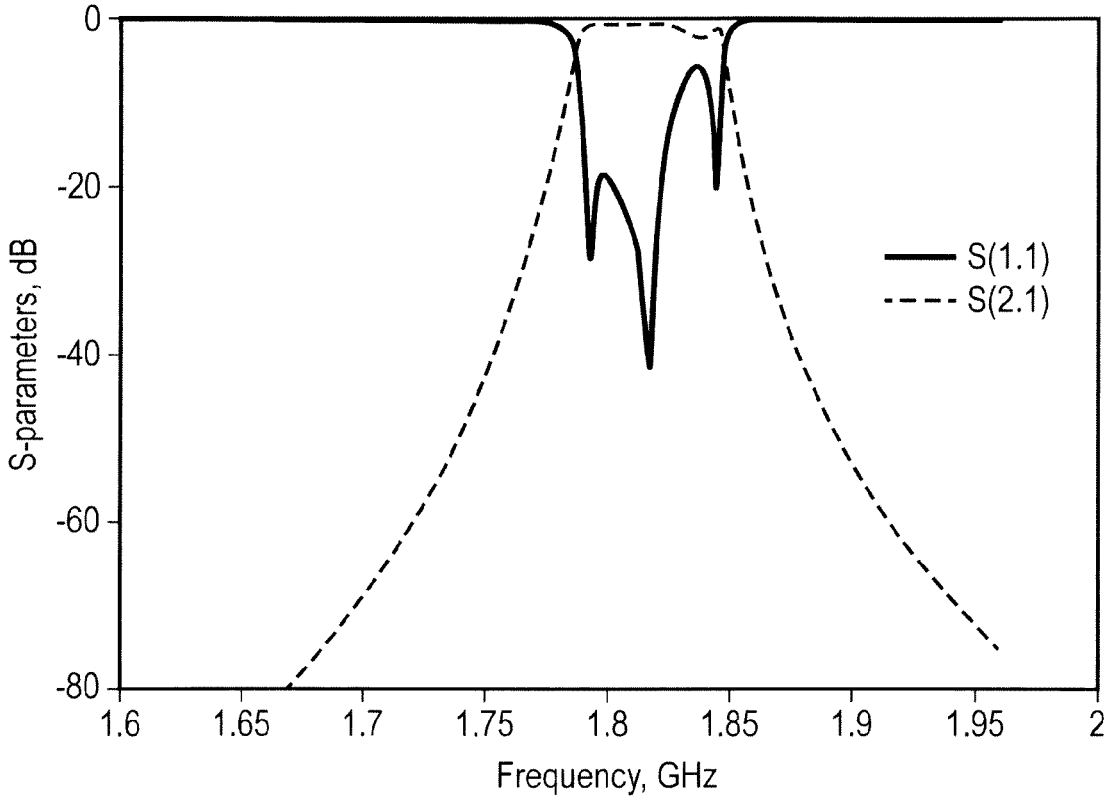
FIGS. 8 and 9 show the simulated response of the filter shown in FIGS. 5(*a*) and 7, respectively.

FIG. 8 is a shows the simulated response of the filter shown in FIG. 5(*a*).

In the embodiments mentioned above, the resonator posts and the resonator covers are formed by a metallic structure (which may be the whole structure or a coating). However, embodiments also envisage forming at least some (or all) of the resonator posts from a ceramic (which may be the whole structure or a coating), with the remainder (if any) being formed from a metal.

Figure 6:
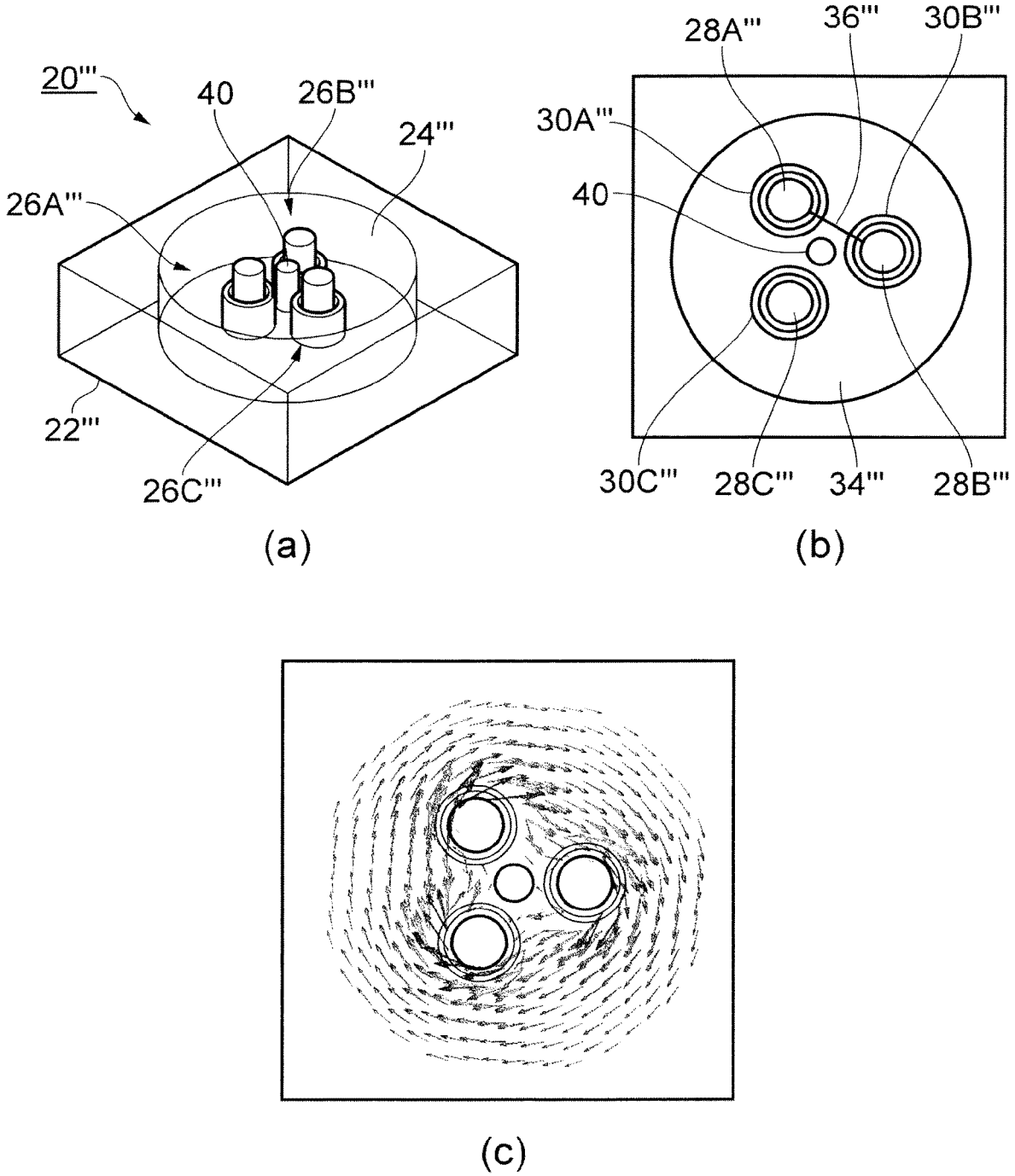
FIG. 6 illustrates a distributed re-entrant resonator structure according to one embodiment where (a) is cross-sectional perspective view, and (b) is a cross-sectional top view and (c) illustrates the magnetic field distribution.

FIG. 6 illustrates a distributed re-entrant resonator structure 20'", where (a) is cross-sectional perspective view, and (b) is a cross-sectional top view and (c) illustrates the magnetic field distribution. The resonator structure 20'" has a cavity enclosure 22'", a cavity 24'" and a number of resonators 26A'"-26C'", and a tuner 40. Each resonator 26A'"-26C'" has two parts, a resonator post 28A'"-28C'" and a resonator cover 30A'"-28C'". Each resonator post 28A'"-28C'" is grounded to one wall (not shown) of the cavity enclosure 22'" and extends into the cavity 24'". Each resonator post 28A'"-28C'" is ceramic. Each resonator cover 30A'"-30C'" is a metallic hollow cylinder and is grounded to an opposing wall 34'" of the cavity enclosure 22'" and extends into the cavity 24'''. Hence, all the resonator posts 28A'''-28C''' protrude into the cavity 24''' from one side/surface.

In operation, a signal is received via an input signal feed (not shown) within the cavity 24'''. The input signal feed magnetically couples with a resonator post 28A'''-28C'''. An electric current flows along the surface of the resonator post 28A'''-28C''' and an electric field is generated at the open end of the resonator post 28A'''-28C''' between that open end and the associated resonator cover 30A'''-30''', which acts as a load on the resonator post 28A'''-28C'''. The electric field is contained by the associated resonator cover 30A'''-30C''', which minimises electrical field coupling between resonator posts 28A'''-28C'''. As shown in FIG. 6(*c*), the magnetic field generated by the resonator post 28A'''-28C''' in response to the input signal feed in turn magnetically couples across an inter-post gap 36''' with adjacent resonator posts 28A'''-28C'''. The magnetic coupling then continues between the resonator posts 28A'''-28C''' and the signal distributes across the array. A filtered signal is then received at an output signal feed (not shown).

In this embodiment the resonators 26A'''-26C''' can be interdigitated as mentioned above or can even be arbitrarily interdigitated.

Filter

Figure 7:
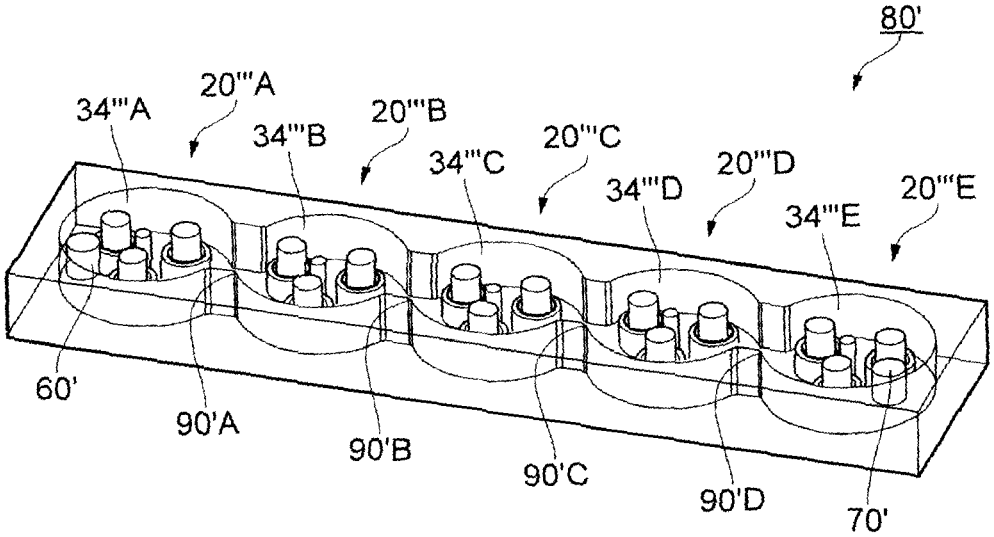
FIG. 7 is a cross-sectional perspective view of a filter arrangement of the re-entrant resonator structure modules according to one embodiment.

FIG. 7 is a cross-sectional perspective view of a filter arrangement 80' of the re-entrant resonator structure modules mentioned above. In this example, 5 modules 20'''A-20'''E are utilised, with inter-module apertures 90'A-90'D provided for magnetic coupling therebetween.

In operation, a signal is received via an input signal feed 60' within the cavity 34'''A. The input signal feed magnetically couples with the resonator posts. Resonator posts within the cavity 34'''A magnetically couple with resonator posts within the cavity 34'''B via the aperture 90'A, which in turn couple with resonator posts within the cavity 34'''C via the aperture 90'B, and so on. A filtered signal is then received at an output signal feed 70'.

It will be appreciated that fewer or more re-entrant resonator structure modules may be provided and that they need not all be identical in configuration. It will also be appreciated that fewer or more than 3 resonators may be provided and that they may be arranged in different configurations, as mentioned above.

Figure 9:
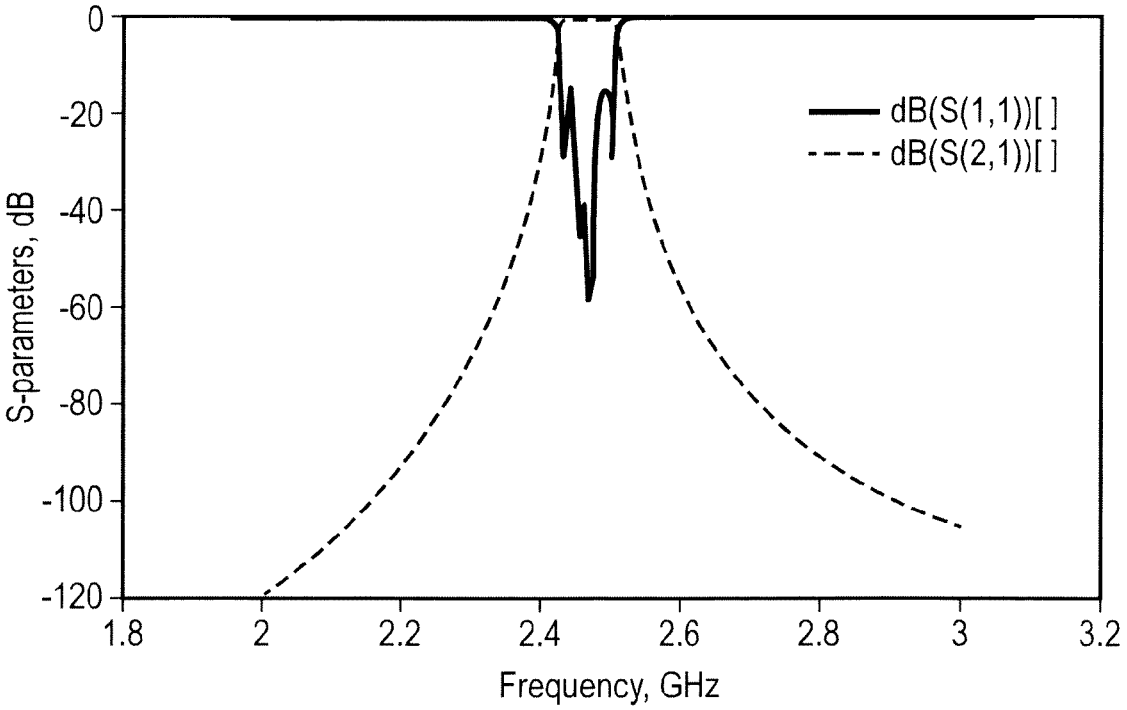

FIG. 9 is a shows the simulated response of the filter shown in FIG. 7. Its insertion loss is 0.32 dB at 2.47 GHz. The height of the resonators is only 10 mm.

Embodiments Utilising Ceramics Provide Remarkable Benefits:

1. High performance—Ceramic material will allow for significant increase in the Q-factor.

2. High frequency/High performance—The improvement will be more and more pronounced as the frequency goes higher.

In addition, embodiments also provide:

3. Low-cost—adopting deep drawn pieces for the top part of the re-entrant resonator (the re-entrant resonators, can be separately made out of deep-drawn pieces and then attached with screws at the lid of the cavity).

4. Low manufacturing complexity—does not require machining on both sides—machining can be not even required once all the bottom elements are screwed to the bottom of the cavity and the top elements are deep-drawn pieces that are also screwed on the lid of the cavity filter.

5. Ease of tuning—requires only a single tuner.

6. Miniaturization factor—with the same number of elements (e.g. 4 elements) reduced frequency of operation.

7. Significant reduced physical volume—(reduced profile and volume).

In one embodiment, the resonator comprises a cavity enclosure, a cavity and numerous main elements (re-entrant resonators/posts), and a tuner. The re-entrant resonator has two parts, a post and a cover hat. The cover protrudes the cavity from the opposite side. All the re-entrant resonators protrude the cavity from one side/surface. The tuner protrudes the cavity from the opposite side. The posts are ceramic posts.

In embodiments, the posts can be partly replaced by ceramic posts, the remaining being metallic. The performance characteristics of the ceramic re-entrant distributed resonator of embodiments is unique and demonstrates the extreme high performance of the resonator.

Embodiments are utilised in a 5 pole filter scenario. All the resonator embodiments above may be fitted to the filter embodiments.

In embodiments, all the posts are replaced by ceramic posts. In embodiments, the posts are partly replaced by ceramic posts. In embodiments, the posts are partly replaced by ceramic posts that extend the entire length of the cavity (TM ceramic resonator). In embodiments, the posts from one side of the cavity only are replaced by the ceramic posts.

In embodiments, different resonator configurations are envisaged:

1. Number of elements: The number of the elements can be arbitrary.

2. Grid: The configuration of the elements can vary. Can be in an inline configuration, rectangular grid, in a circular grid, elliptical, or alike. A skewed grid can also be considered.

3. Shape of posts and re-entrant hats. The shape can also be arbitrary, can be a circular one, rectangular, elliptical or alike.

4. The shape can be different from the inner side and from the outer side. For, example the re-entrant hat can be made rectangular outside and circular inside, or the opposite.

In embodiments, the number of resonators is selectable dependent on design requirements. Also, the configuration of the resonators can vary dependent on design requirements. For example, the resonators can be in an inline configuration, a rectangular grid, a circular grid, triangular grid, elliptical, or alike. Furthermore, the shape of resonator posts and re-entrant hats can also be arbitrary. For example, the can be circular, rectangular, elliptical or alike. In one embodiment, the resonator caps are discontinuous (for example a quarter cylinder to shield only adjacent resonator caps) and only partially surround the resonator post. This simplifies manufacture and reduces weight.

Embodiments simultaneously provide for reduced physical dimensions of cavity filters and improved performance of cavity filters. Both qualities are greatly valued in industrial applications. This is because filters are typically the bulkiest and heaviest subsystems in mobile cellular base stations, rivalled only by power-amplifier heatsinks. Therefore filter miniaturization is always desired. Embodiments offer high performance in these physical volume constraints.

Embodiments provide a miniaturised resonator that simultaneously achieves size reduction and high performance. No known coaxial resonator at present manages to achieve these characteristics. In particular, for the same volume as a standard resonator depicted in FIG. 1, the presented embodiments of the miniaturised resonator achieve significant higher performance. A benefit of this technology is that it does allow the conventional machining of the filter cavity to be employed.

Figure 10:
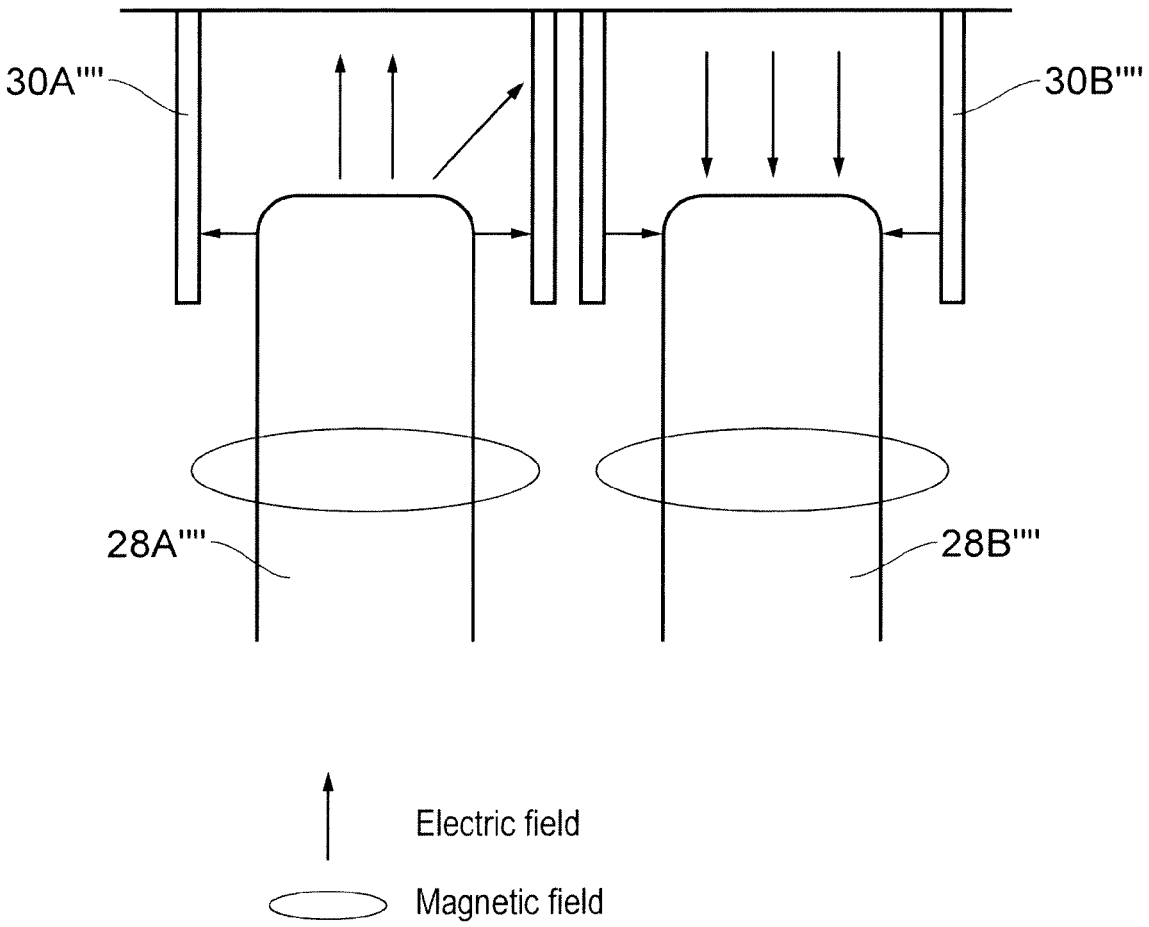
FIG. 10 illustrates schematically the magnetic field and electrical fields according to one embodiment.

As illustrated in FIG. 10, in embodiments, the caps 30A"", 30B"" contain the electric field between the resonator element 28A"", 28B"" and its resonator cap 30A"", 30B"", thus preventing or reducing the electric field coupling between resonators. If there is both magnetic and electric coupling between two resonators, then they tend to cancel each other and reduce the total coupling between resonators. In embodiments, the resonator cap 30A"", 30B"" contains the electric field by loading the resonator element 28A"", 28B"" with the resonator cap 30A"", 30B"", which increases the total coupling between two resonators and improves performance.

A person of skill in the art would readily recognize that steps of various above-described methods can be performed by programmed computers. Herein, some embodiments are also intended to cover program storage devices, e.g., digital data storage media, which are machine or computer readable and encode machine-executable or computer-executable programs of instructions, wherein said instructions perform some or all of the steps of said above-described methods. The program storage devices may be, e.g., digital memories, magnetic storage media such as a magnetic disks and magnetic tapes, hard drives, or optically readable digital data storage media. The embodiments are also intended to cover computers programmed to perform said steps of the above-described methods.

The functions of the various elements shown in the Figures, including any functional blocks labelled as "processors" or "logic", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" or "logic" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included. Similarly, any switches shown in the Figures are conceptual only. Their function may be carried out through the operation of program logic, through dedicated logic, through the interaction of program control and dedicated logic, or even manually, the particular technique being selectable by the implementer as more specifically understood from the context.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. A resonator assembly, comprising:

a resonant chamber defined by a first wall, a second wall opposing said first wall and side walls extending between said first wall and said second wall;

a first resonator comprising a first resonator element and a first resonator cap, said first resonator element having a first grounded end and an first open end, said first resonator element being grounded at said first grounded end on said first wall and extending into said resonant chamber, said first resonator cap having a first grounded portion and an first open portion, said first resonator cap being grounded at said first grounded portion on said second wall and extending into said resonant chamber to at least partially surround said first open end of said first resonator element with said first open portion for electrical field loading of said first resonator element by said first resonator cap; and a second resonator comprising a second resonator element and a second resonator cap located for electrical field loading of said second resonator element by said second resonator cap, said second resonator element being located for magnetic field coupling between said first resonator element and said second resonator element.

2. The resonator assembly of claim 1, wherein said second resonator element has a second grounded end and a second open end, said second resonator element being grounded at said second grounded end on one of said first wall and said second wall and extending into said resonant chamber, and said second resonator cap has a second grounded portion and a second open portion, said second resonator cap being grounded at said second grounded portion on another one of said first wall and second wall, said second resonator cap extending into said resonant chamber to at least partially surround said second open end of said second resonator element with said second open portion for electrical field loading of said second resonator element by and said second resonator cap.

3. The resonator assembly of claim 1, comprising at least one further resonator, each comprising a further resonator element and a further resonator cap, adjacent resonator elements being located for magnetic field coupling therebetween.

4. The resonator assembly of claim 1, wherein each resonator element is one of metallic and ceramic.

5. The resonator assembly of claim 1, wherein at least one resonator element is ceramic and at least one resonator element is metallic.

6. The resonator assembly of claim 1, wherein said resonator caps are metallic.

7. The resonator assembly of claim 1, wherein said resonator elements each comprise an elongate post.

8. The resonator assembly of claim 1, wherein said resonator elements each have an effective electrical length of around one eighth of an operating wavelength of said resonator assembly.

9. The resonator assembly of claim 1, wherein said resonator caps each surround a respective resonator element.

10. The resonator assembly of claim 1, wherein said resonator caps each comprise a tube extending at least partially along an axial length of a respective resonator element.

11. The resonator assembly of claim 1, wherein an internal shape of said resonator caps each match an external shape of a respective resonator element.

12. The resonator assembly of claim 1, wherein said resonator caps are unitary.

13. The resonator assembly of claim 1, wherein each resonator is arranged in at least one of a linear, triangular grid, circular grid, rectangular grid and elliptical grid layout for magnetic field coupling between adjacent resonator elements.

14. The resonator assembly of claim 1, comprising a plurality of adjacent resonant chambers, each having a plurality of said resonators.

15. A method of radio frequency filtering, comprising passing a signal for filtering through a resonant assembly as claimed in claim 1.

* * * * *